United States Patent [19]

Gloeckler

[11] 3,995,453

[45] Dec. 7, 1976

[54] ELECTRIC DEVICE FOR SELECTING THE NEEDLES OF A RECTILINEAR KNITTING MACHINE

[75] Inventor: Alfred Marcel Gloeckler, Riedisheim, France

[73] Assignee: Superba, Mulhouse, France

[22] Filed: July 30, 1974

[21] Appl. No.: 493,081

Related U.S. Application Data

[63] Continuation of Ser. No. 338,845, March 7, 1973, abandoned.

[30] Foreign Application Priority Data

Mar. 6, 1972 France ..... 72.09732

[52] U.S. Cl. ..... 66/75 A; 66/154 A

[51] Int. Cl.[2] ..... D04B 7/00; D04B 15/66

[58] Field of Search ..... 66/75, 154 A, 155

[56] References Cited

UNITED STATES PATENTS

| | | | |
|---|---|---|---|
| 2,072,969 | 3/1937 | Tandler | 66/154 A |
| 3,434,305 | 3/1969 | Bentley et al. | 66/155 X |
| 3,656,321 | 4/1972 | Flad | 66/75 |
| 3,776,003 | 12/1973 | Krause | 66/154 A |
| 3,805,558 | 4/1974 | Protti | 66/154 A |

FOREIGN PATENTS OR APPLICATIONS

| | | | |
|---|---|---|---|
| 1,435,132 | 10/1968 | Germany | 66/75 |
| 1,165,368 | 9/1969 | United Kingdom | 66/154 A |

*Primary Examiner*—Ronald Feldbaum
*Attorney, Agent, or Firm*—McNenny, Pearne, Gordon, Gail, Dickinson & Schiller

[57] ABSTRACT

An electric device selects the needles of a rectilinear knitting machine. A carriage which moves in front of the needles is provided with an electro-magnetic member which successively operates the needls during its displacement. The device includes a memory member containing data for activating the electromagnetic member to operate the needles required for making a determined width of a knitting. A scanning installation scans the memory member synchronously with the displacement of the carriage.

4 Claims, 2 Drawing Figures

ELECTRIC DEVICE FOR SELECTING THE NEEDLES OF A RECTILINEAR KNITTING MACHINE

This application is a continuation of application Ser. No. 338,845, filed Mar. 7, 1973 and now abandoned.

In an already known device for selecting needles, of the same type as the precedent one, date are successively scanned according to a cycle. The width of the pattern of the knitting is then determined, and can anyway be modified but by changing the support of the program. Now, such a change is onerous.

It is already known to use, as a program support, an endless film made of an insulating material, which is displaced synchronously with the displacement of the carriage and on which perforations are provided along a spiral line. These perforations are successively scanned so as to produce impulses for selecting the needles. In that case, the width of the pattern is determined by the width of the film, and it is then necessary to change the support of the program when the width of the pattern is to be modified. This operation is also onerous.

The purpose of the present invention is to allow to change the width of the pattern without modifying the program support.

To this end, the installation comprises an assembly of electrically conducting sectors, radially arranged and connected to the memory member, at least an electrical contact stud which moves synchronously with the displacement of the carriage, which applies successively on the sectors, and several connecting strips for producing electrical contacts, movable and of a different length, and electrically connected to the electromagnetic means which operates the needles, and which apply onto the movable contact stud.

It is then possible to each time bring the connecting strip corresponding to the width of the pattern desired into a position where it is connected to a contact stud scanning the sectors.

When the contact connecting strips extends over all the sectors, the width of the pattern is then maximum.

On the other hand, when a contact connecting strip shorter than the distance between the two extreme sectors is selected in association with contact studs, one portion only of the sectors is scanned, so that the width of the pattern is shortened accordingly. It is then easily possible to modify the width of the patterns to be made without being necessary to either modify or change the contact support.

Thanks to its simple construction, the installation according to the invention is particularly quite suitable for family rectilinear knitting machines.

The pattern is determined by the presence or absence of a potential difference on each of the sectors, so that continuous impulses for selecting the needles are produced, the period of which determines the ratio of widths.

Figure 1:
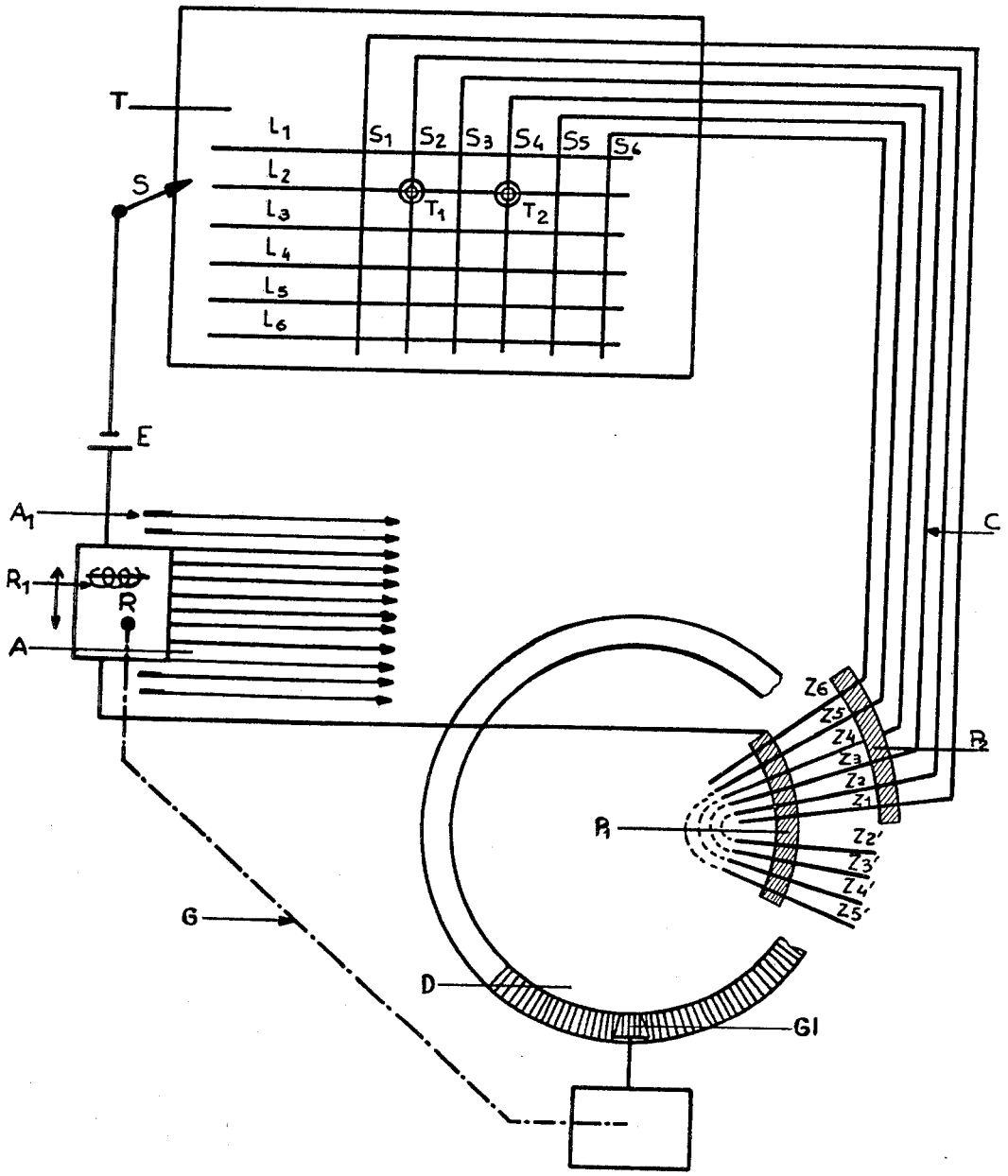
Figure 2:
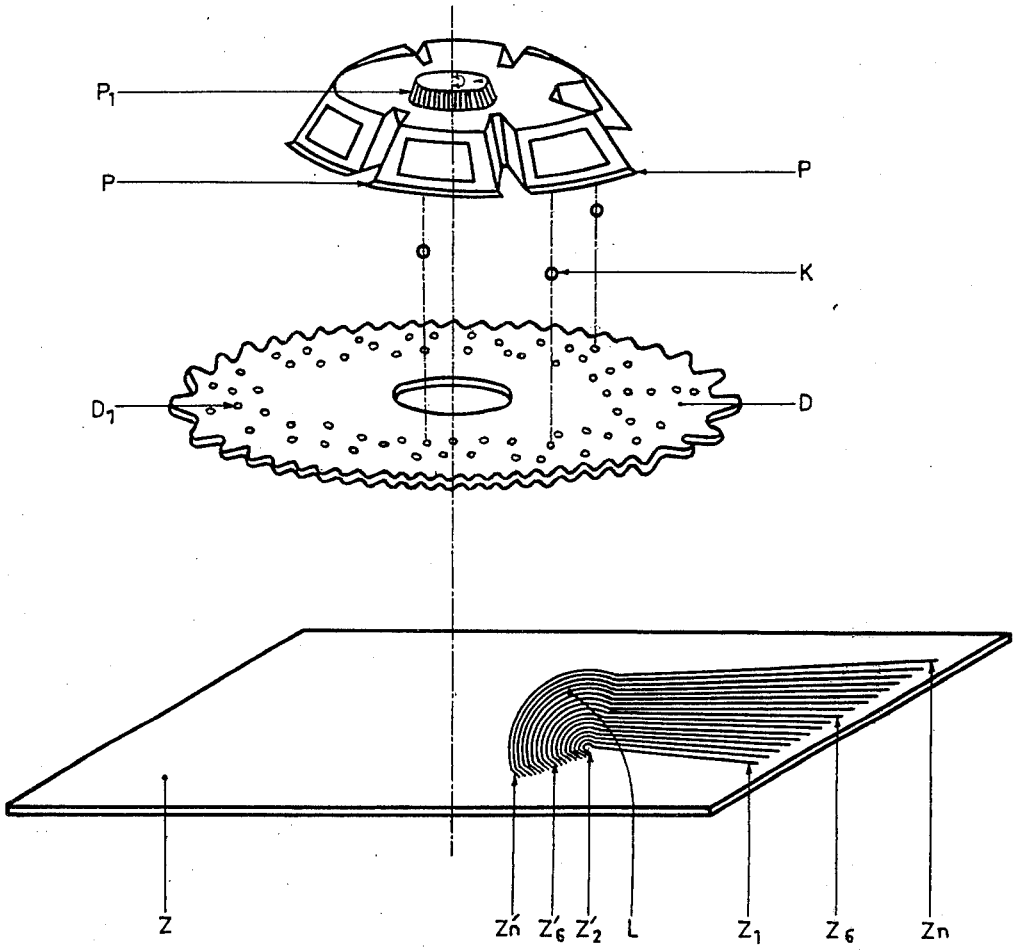

The invention is explained by means of the drawings attached therein, in which:

FIG. 1 diagrammatically shows the principle for working out the selection device, FIG. 2 is an example of embodiment of the installation producing continuous impulses for selecting the needles with adjustable scanning periods, this Figure being an exploded view.

The reference T of FIG. 1 shows a memory member containing data for operating needles for making a pattern whose width is determined, during a knitting operation.

By way of example, the said memory member has the shape of a die comprising a series of conducting rows L1 to L6 and conducting columns S1 to S6, said rows and columns can be electrically connected at their intersection by, for example, driving therein a stud, as diagrammatically shown at T1 and T2.

Furthermore, it can be seen in FIG. 1 the carriage R, provided with an electro-magnetic member R1 acting, depending on whether it is under voltage or not, on the heels of the needles A, so as to place them or not in a selection position.

This carriage, which displaces along the bed of the knitting machine needles, is electrically connected to an electrical contact finger S by means of a source of energy E, the said electrical contact finger S can be displaced for being electrically connected with either of the rows L1 to L6 of the die T.

The contact finger S is moved to successive rows of the dye T as successive rows are knit on the carriage R.

Besides, the columns S1 to S6 of this die are connected to sectors Z1 to Z6 of an installation for scanning the memory member, whilst this scanning installation comprises a movable disc D, which rotates synchronously with the displacement of the carriage R by means of a mechanical or electrical transmission diagrammatically shown at K.

The scanning installation shown in detail in FIG. 2, comprises a disc D made of an insulating material which rotates synchronously with the displacement of the carriage through, for example, the transmission G and the geared driving G1.

The disc D is provided with perforations D1, each receiving a contact stud in the form of an electrically conducting ball K which may, for example, be made of steel, and whose diameter is a little greater than the thickness of the said disc D.

The perforations are made along concentric circumferences. The perforations on each circumference are spaced from one to the other according to an angle at the center, this angle at the center corresponding to the rotation angle of the disc 1 when the carriage of the machine is displaced in the front of a group of needles which determine the width of the knitting on which the selection is to be made.

In other words, if the disc D rotates 45° when the carriage R is displaced across a single width of the knitting, the balls in the perforations D1 in the disc D are spaced 45° apart so that a successive ball moves across the sectors on the plate Z with each such displacement of the carriage R.

Of course, the angles at the center of two successive perforations on different concentric circumferences are themselves different so as to allow the selection to be made on a different width of knitting, as it will be seen hereafter.

The disc D rests, through the balls protruding one of its faces, on the plate Z. The latter consists of an insulating support on which a certain number of electrically conducting sectors Z1, Z2, Zn are provided, which are radially arranged with respect to the rotation axis of the disc D. The angle at the center which encloses two close sectors is identical to the angle of rotation of the disc D when the carriage of the machine is displaced from a needle A to the other.

Above the disc D, is mounted a rotating support made of an insulating material provided with several contact connecting strips electrically conducting, in the form of an arc of a circle having a radius different. Each radius of the connecting strips corresponds to the radius of one of the perforation circumferences D1 of the support D, so that each contact connecting strip is provided, perpendicularly above a perforation circumference D1, with balls K. In the same way, each connecting strip P defines a different angle at the center, each corresponding to a multiple of the angle of rotation made by the disc D when the carriage is displaced by one needle step A. The different angles at the center of the connecting strips in the form of an arc P thus determine, in association with the balls of the corresponding circumference of balls, the width of the knitting patterns likely to be made with the machine.

When the disc D rotates, the balls K, which belong to one and the same circumference, are electrically connected one after the other by their upper protuberant portion with a connecting strip P having the same radius. The angle at the center of each contact connecting strip is then equal to the angle at the center defined by the "n" first close sectors Z, "n" also being the number of the needles which belong to one and the same group intended for producing a width of pattern. It may consequently be seen that whilst the disc D rotates synchronously with the displacement of the carriage R, the balls K, which are distributed on one and the same circumference, initiate one after the other a conducting connection between each of the sectors Z involved and the corresponding contact connecting strip P, while the strip remains stationary as the disc D rotates. Thereby, the selection data, in the form of a presence or absence of a difference in potential, are successively brought, from each of the sectors Z, onto the electro-magnetic driving member of the carriage securing operating of the needles, these data being periodically repeated during displacements of the carriage each time a ball is placed between the sectors Z involved and the bar arranged just above. It results therefrom that when a sector Z is scanned by a ball K, the heel A1 of the needle affected to the said sector Z is always brought with precision in front of the electromagnetic selection member R1.

In the example shown in drawings, each of the sectors Z described hereabove is electrically connected through an electrical connection L with a sector Z'2, Z'6 to Z'n symmetrically distributed with respect to a central sector Z1. These sectors Z' have a length such as they also may be contacted by the balls K which are located inside the perforations of the disc D1, so as to initiate electrical connections. In such a case, when the disc D rotates, the balls K, which are on the circumference of the contact connecting strip P set in position, cause continuous impulses of "Zn" periods and, in that case, the data contained in the "n" sectors Z'n and the impulses which they initiate, are symmetrical with the data which are in the sectors Zn. Consequently, such an arrangement allows to double the number of the needles of a group of needles knitting a width of a pattern with an effect on but the half portion of the pattern, provided the pattern which is desired to produce has a symmetrical axis. In other words, as shown in FIG. 1, there may be two connecting strips $P_1$ and $P_2$. If the strip $P_2$ is positioned over the sectors $Z_6$ - $Z_1$, a ball of the disc D which is in vertical alignment with the strip $P_2$ will successively connect each of the sectors $Z_6$ - $Z_1$ to the strip $P_2$ as the disc D is rotated clockwise. If the strip $P_1$ is positioned over the sectors $Z_6$ - $Z_1$, a ball of the disc D which is in vertical alignment with the strip $P_1$ will successively connect each of the sectors $Z_6$ - $Z_1$ to the strip $P_1$ and will thereafter successively connect each of the sectors $Z_2$ - $Z_5$ to the strip $P_1$ as the disc D is rotated clockwise.

Adjustment of the angular position of the piece P1, and thus of the various contact connecting strips in the form of an arc P assigned to the balls K on the circumference of the disc D, allows to choose the number of needles A to be used on the machine for making a width of pattern, by assigning to a determined contact connecting strip P a determined number of sectors Z.

The maximum number of sectors Z, which determines the greatest width of a pattern likely to be produced is practically limited but by the space available on the plate Z. The same applies to the number of circumferences on the disc D and to the corresponding number of contact connecting strips P, which determine the number of patterns which can be produced in the width of a knitting.

Of course, the invention is not limited to the examples of embodiment described and presented hereabove, from which other forms and modes of embodiment can be provided without, thereby, departing from the scope of the invention.

What is claimed is:

1. An electric device for selecting the needles of a rectilinear knitting machine, comprising a carriage which is displaced in front of the needles, said carriage being provided with an electro-magnetic member for successively operating the needles during its displacement in response to an electrical signal, a memory member containing data for supplying an electrical signal to activate the electro-magnetic member to operate the needles in relation to a determined width of a knitting, an installation for scanning the memory member synchronously with the displacement of the carriage, said installation including electrically conducting sectors radially distributed in circumferentially spaced apart relation, first electrical connection means electrically connecting each of said sectors to the memory member, a rotatable member adjacent said sectors mounted for rotational movement relative to said sectors, drive means rotating said rotatable member synchronously with the displacement of the carriage, said rotatable member carrying at least one electrical contact stud movable along a circular path with the rotation of said rotatable members and electrically contacting successive ones of said circumferentially spaced sectors, and a plurality of electrical contact connecting strips of different lengths, second electrical connection means electrically connecting each of said strips to the electro-magnetic member which operates the needles, and said movable contact stub being electrically connected to one of said strips as said stub moves along said circular path whereby said data is electrically transmitted from said memory member through said sectors and said stub and said strip to said electro-magnetic member.

2. A device according to claim 1, wherein the installation comprises several electrical contact stubs distributed in concentric circumferences on an insulating support disc which synchronously rotates with the displacement of the carriage, the circumferential spacing of the contact stubs of a same circumference being identical, the contact connecting strips of a different length being arc-shaped, the length and radius of which are different from each other, made on an insulating rotative support, the radius of each of the connecting strips in the form of an arc of a circle corresponding to the radius of one of the concentric circumferences of the electrical contact stubs.

3. A device according to claim 2, wherein the contact stubs consist of metallic balls embedded in the concentric perforations of the disc, the said disc and balls being arranged between the radial sectors and the connecting strips.

4. A device according to claim 1, wherein the electrically conducting sectors radially distributed are connected to a second group of close sectors, also radially distributed, each sector of the first group being connected to a sector of the second group, according to a symmetrical arrangement.

* * * * *